United States Patent [19]

Buckley

[11] Patent Number: 4,622,715

[45] Date of Patent: Nov. 18, 1986

[54] FRICTION SUPPORTING STAYS FOR WINDOWS

[75] Inventor: John E. Buckley, Tewkesbury, England

[73] Assignee: Securistyle Limited, Nottingham, England

[21] Appl. No.: 673,658

[22] Filed: Nov. 21, 1984

[30] Foreign Application Priority Data

Nov. 24, 1983 [GB] United Kingdom ..... 8331411

[51] Int. Cl.[4] ..... E05D 7/12

[52] U.S. Cl. ..... 16/370; 49/248; 49/252

[58] Field of Search ..... 16/341, 337, 345, 352, 16/362, 363, 371, 374, 324, 193, 1 R, 1 C, 342, 352, 370; 49/248, 252, 260

[56] References Cited

U.S. PATENT DOCUMENTS 2,763,037 9/1956 Benton et al. ..... 49/248
3,258,874 7/1966 Martin ..... 49/252
4,449,327 5/1984 Nielsen ..... 49/252

FOREIGN PATENT DOCUMENTS 2081803 2/1982 United Kingdom ..... 16/370
2047309 1/1983 United Kingdom .

*Primary Examiner*—Donald R. Schran
*Assistant Examiner*—James L. Wolfe
*Attorney, Agent, or Firm*—Jerry W. Mills; Gregory M. Howison

[57] ABSTRACT

A friction stay includes a track 10 for attachment to a window frame. The track 10 has a nose portion 14 with a curved inner surface which receives the nose portion 28 of a bar 24. Bar 24 is pivotally attached to the track 10, by a link 16 joined to the bar 24 at rivet 25 and to track 10 at rivet 17. The bar 24 is also attached to a slider 15, engaged in track 10, by a link 21 pivoted on rivets 22, 23. A brace 18 extends from link 16 to slider 15 and is attached by rivets 19, 20. Optionally an extra link 26 may be included. To provide additional strength, in accordance with this invention, a link 31 is provided, pivoted to link 16 at 32 and to a second slider 35 to 34.

8 Claims, 4 Drawing Figures

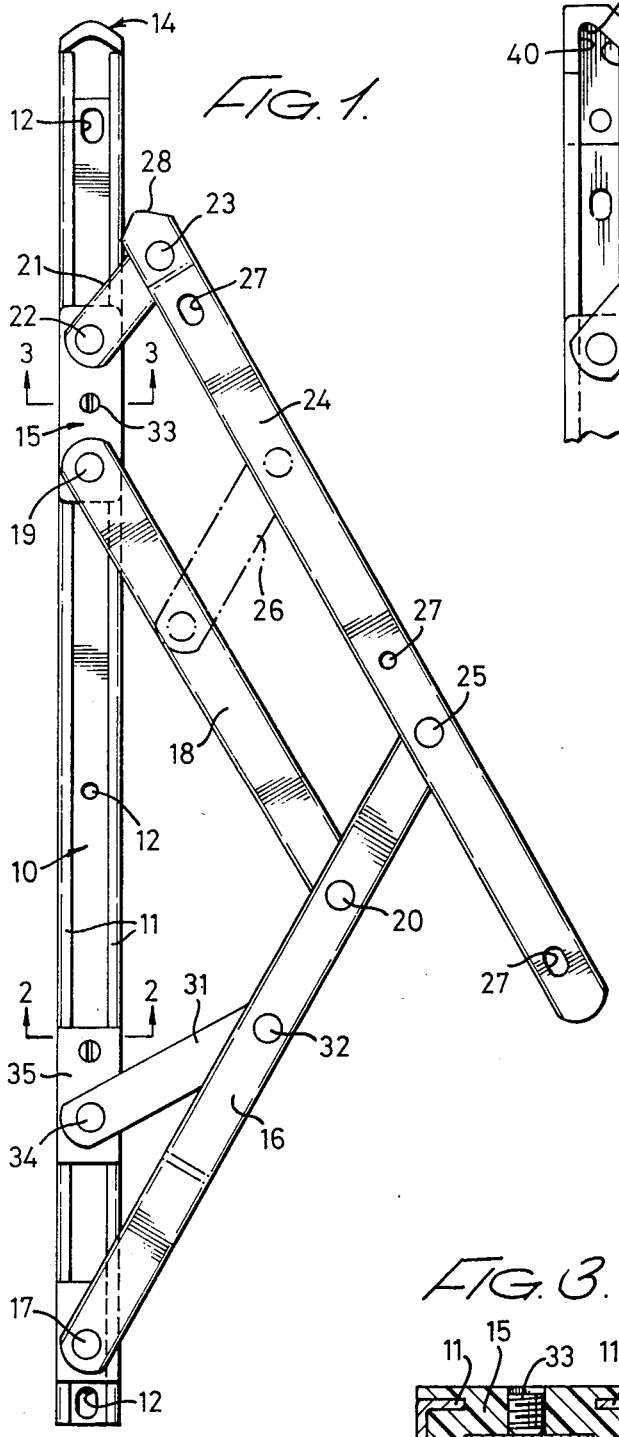
FIG. 1.
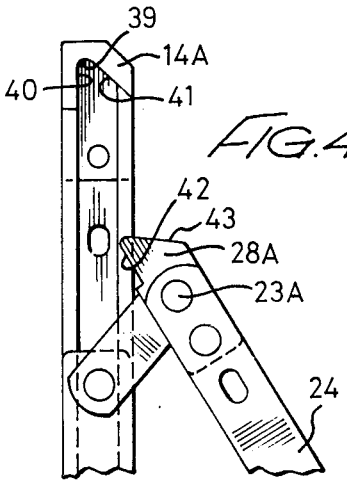
FIG. 4.
FIG. 2.
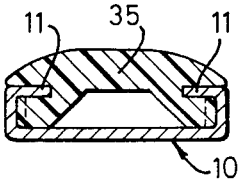
FIG. 3.
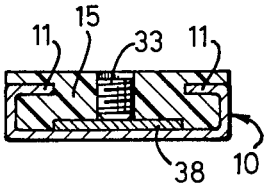

FRICTION SUPPORTING STAYS FOR WINDOWS

TECHNICAL FIELD OF THE INVENTION

The invention relates to friction supporting stays, for windows, of the kind (hereinafter referred to as "of the kind described") comprising a track, a slider movable along the track, a strut pivotally connected to the track, a brace pivotally connected between the slider and the strut, a link pivotally connected to the slider, and a bar pivotally connected to the link and to the strut, the arrangement being such that as the slider moves along the track the bar can swing from a position overlying the track to a position where it is angled with respect to the track.

BACKGROUND OF THE INVENTION

In use, two such supporting stays are normally provided at opposite sides of a window, the track of each stay being mounted on the window frame and the bar being mounted on the window sash. The arrangement is such that as the window pivots on the stays, about either a vertical or a horizontal axis, the axis of pivoting of the window sash moves away from the window frame so that when the window is open both sides thereof are accessible from one side of the window frame.

The window sash is frictionally restrained in any angular position in which it is set. This frictional restraint may be provided partly by the friction at the pivotal connections between the various elements but is largely provided by the frictional engagement between the slider and the track.

In friction supporting stays of the kind described, particularly when used for supporting side hung windows where the weight is acting downwardly on the stay, there is a tendency for the link to flex under the weight thus causing malfunction of the window.

SUMMARY OF THE INVENTION

An object of this invention is to provide a modified form of stay, of the kind described, in which this tendency is reduced or eliminated.

According to the invention, in a friction supporting stay of the kind described, an additional link is provided between the track and the strut adapted to provide extra support for the downwardly acting weight of a window supported by the stay.

Preferably the extra link is pivoted at one end to the strut and at the other end to an additional slider engaged in the track.

Preferably the extra link is pivoted to the strut substantially at or adjacent the mid-point of the strut.

Optionally a further additional link may be provided between the brace and the bar.

Optionally the track has an offset nose portion adapted to receive a cooperating offset nose portion on one end of the bar, the offset portions cooperating to ensure a tight and uniform closing action of the hinge.

BRIEF DESCRIPTION OF THE DRAWINGS

In the accompanying drawings:

FIG. 1 is an elevation of a window stay embodying the present invention;

FIGS. 2 and 3 are sections, respectively on lines 2—2 and 3—3 shown in FIG. 1; and FIG. 4 is an elevation of a modification of the upper end of the stay shown in FIG. 1.

DETAILED DESCRIPTION OF THE INVENTION

The stay comprises a track 10 which can be attached to a window frame by screws (not shown) passing through holes 12. The track 10 has, at its upper end as seen in the drawing, a nose portion 14 of plastic with a curved inner surface adapted to receive the nose portion 28 of a bar 24 which has holes 27 for receiving screws by which the window sash may be attached to bar 24. The sash will normally be supported by a pair of these stays, one on each side of the window.

Bar 24 is pivotally attached to the track 10, by a link 16 joined to the bar 24 at rivet 25 and to track 10 at rivet 17. The bar 24 is also attached to a slider 15, engaged in track 10, by a link 21 pivoted on rivets 22,23.

A brace 18 extends from link 16 to slider 15 and is attached by rivets 19,20. Optionally an extra link 26 may be included.

To provide additional strength, in accordance with this invention, a link 31 is provided, pivoted to link 16 at 32 and to a second slider 35 at 34.

FIG. 2 is a section through slider 33 and shows how the slider is engaged to run on flanges 11 on track 10. FIG. 3 is a section through slider 15 and shows how pressure on the slider may be adjusted by screw 33 bearing on a pressure plate 38 which abuts the track 10.

The link 31 provides additional support to take the weight of the window and to prevent flexing of the link 16 and consequent malfunction of the stay. This is particularly valuable in a window with side hung hinges.

The upper end of the stay may be modified as shown in FIG. 4 in which the nose portion 14A, which is a separate piece rivetted to the stay, has an offset apex 39 formed between angled surfaces 40,41, the apex 39 being offset to the left of the longitudinal axis of the stay. Similarly nose portion 28A on the bar 24 is a separate plastic moulding held on by a rivet 23A. Nose portion 28A is formed between two surfaces 42,43 inclined to each other so as to offset the apex of nose portion 28A to the left of the longitudinal centre line of the bar 24. This arrangement is described in more detail in UK patent application No. 8333196.

The combination of the strut 31 and the offset nose portions ensures a tight and strong hinge action with adequate support for the weight of a heavy window.

Sloppiness in the hinge and wear resulting from that sloppiness is avoided thus giving the hinge a longer life.

What is claimed is:

1. A friction supporting stay for a window of the kind comprising a track, a slider movable along the track, a strut pivotally connected to the track, a brace pivotally connected between the slider and the strut, a link pivotally connected to the slider, and a bar pivotally connected to the link and to the strut, the arrangement being such that as the slider moves along the track the bar can swing from a position overlying the track to a position where it is angled with respect to the track, in which an additional link is provided between the track and the strut adapted to provide extra support for the downwardly acting weight of a window supported by the stay and comprising an additional slider, in which the extra link is pivoted at one end to the strut and at the other end to the additional slider which is engaged in the track.

2. A stay according to claim 1 and in which the extra link is pivoted to the strut proximate the mid-point of the strut.

3. A stay according to claim 1 and in which a further additional link is provided between the brace and the bar.

4. A stay according to claim 1 and in which the track has an offset nose portion adapted to receive a cooperating offset nose portion on one end of the bar, the offset portions cooperating to ensure a tight and uniform closing action of the hinge.

5. The combination of a window sash and a pair of stays according to claim 1, one stay being located on each side of the window to support the window in a frame.

6. A friction supporting stay, comprising:

a track;

a slider movable along said track;

a strut having first and second ends with the first end thereof pivotally connected to said track;

a brace having first and second ends, the first end thereof pivotally connected to said strut and the second end thereof pivotally connected to said first slider;

a link having first and second ends with the first end thereof pivotally connected to said first slider;

a metal bar having first and second ends with the first end thereof pivotally connected to the second end of said link with the second end of said strut being pivotally connected to said bar such that said bar extends between said link and said strut with said bar being in a first and closed position and overlying said track when said slider moves away from the pivoting point of said strut with said track and said bar being in an open and extended position when said slider moves along said track toward the pivoting point of said strut on said track;

a second slider disposed between said first slider and the pivoting point of said strut on said track; and an additional link having first and second ends, said first end pivotally mounted on said second slider and the second end thereof pivotally attached to said strut between the first and second ends thereof, said link providing additional support to said strut when said bar is in the open and extended position.

7. The friction supporting stay of claim 6 wherein said second slider moves toward the pivot point of said strut on said track when said bar goes from the open and extended position to the closed and overlying position and said second slider moves away from the pivot point of said strut on said track when said bar moves from the overlying and closed position to the open and extended position.

8. The friction supporting stay of claim 7 wherein the second end of said link is pivotally attached proximate the midpoint of said strut.

* * * * *